US008806785B2

(12) United States Patent
Brufau Guinovart et al.

(10) Patent No.: US 8,806,785 B2
(45) Date of Patent: Aug. 19, 2014

(54) WEARING ELEMENT WITH ENHANCED WEAR RESISTANCE

(75) Inventors: Jordi Brufau Guinovart, Vallromanes (ES); Jorge Alcala, Barcelona (ES); Jorge Triginer Boixeda, Barcelona (ES); Jose Sanchez, Premia de Dalt (ES); Jose Lopez Almendros, Barcelona (ES)

(73) Assignee: Metalogenia, S.L., Premia de Mar (ES)

( * ) Notice: Subject to any disclaimer, the term of this patent is extended or adjusted under 35 U.S.C. 154(b) by 0 days.

(21) Appl. No.: 13/321,047

(22) PCT Filed: May 28, 2010

(86) PCT No.: PCT/EP2010/003245

§ 371 (c)(1),
(2), (4) Date: Feb. 14, 2012

(87) PCT Pub. No.: WO2010/136207

PCT Pub. Date: Dec. 2, 2010

(65) Prior Publication Data

US 2012/0131820 A1 May 31, 2012

Related U.S. Application Data

(60) Provisional application No. 61/213,321, filed on May 29, 2009.

(30) Foreign Application Priority Data

Jul. 1, 2009 (WO) ..... PCT/ES2009/000352
Aug. 10, 2009 (WO) ..... PCT/EP2009/005802

(51) Int. Cl.

| | |
|---|---|
| ***E02F 3/00*** | (2006.01) |
| ***E02F 3/815*** | (2006.01) |
| ***C22C 29/08*** | (2006.01) |
| ***E02F 9/28*** | (2006.01) |
| ***B22D 19/06*** | (2006.01) |
| *B22F 5/00* | (2006.01) |

(52) U.S. Cl.

CPC ..... *B22D 19/06* (2013.01); *E02F 3/8152* (2013.01); *C22C 29/08* (2013.01); *E02F 9/285* (2013.01); *B22F 2999/00* (2013.01); *B22F 2005/001* (2013.01); *E02F 9/2883* (2013.01); *C22C 2204/00* (2013.01)

USPC ..... 37/460

(58) Field of Classification Search

CPC ..... B22D 19/06; B22F 7/064; B22F 7/06; B22F 7/08; B22F 2003/244; B22F 2998/00; C22C 19/07; C22C 16/34; C22C 16/40; C22C 29/005; C22C 29/02; E21B 10/52; E21B 10/56; E21B 10/60; E21B 21/10; E21B 4/14; E21B 10/567; E21B 7/068; E21B 7/064; E21B 7/067; E21C 35/183

USPC ..... 37/450–460; 175/56, 296, 297, 299, 175/317, 61, 73, 428, 420.2, 434, 425, 433; 75/246, 374; 299/105, 111; 419/10

See application file for complete search history.

(56) References Cited

U.S. PATENT DOCUMENTS 4,024,902 A 5/1977 Baum
4,584,020 A 4/1986 Waldenström (Continued)

FOREIGN PATENT DOCUMENTS

WO 2009/061274 A1 5/2009

OTHER PUBLICATIONS

Machine Translation of JP 1998-203921, Published Aug. 1998.*

(Continued)

*Primary Examiner* — Robert Pezzuto
(74) *Attorney, Agent, or Firm* — Sughrue Mion, PLLC

(57) ABSTRACT

Wearing element with enhanced wear resistance related to wearing elements, such as cast steel teeth to be specially used in machinery for earth-moving, ground-engaging and/or rock-cutting applications, as well as to inserts to be included within the wearing elements, to enhance their wear resistance thus prolonging their service life.

19 Claims, 4 Drawing Sheets

(56) References Cited

U.S. PATENT DOCUMENTS

| | | | | |
|---|---|---|---|---|
| 4,764,255 | A | 8/1988 | Fischer et al. | |
| 4,907,665 | A | 3/1990 | Kar et al. | |
| 5,081,774 | A | 1/1992 | Kuwano | |
| 8,277,722 | B2 * | 10/2012 | Digiovanni | 419/10 |
| 8,323,372 | B1 * | 12/2012 | Fang et al. | 75/246 |
| 8,397,841 | B1 * | 3/2013 | Griffo et al. | 175/428 |
| 8,512,865 | B2 * | 8/2013 | DiGiovanni | 428/408 |
| 8,562,703 | B2 * | 10/2013 | Eyre et al. | 51/309 |
| 8,627,904 | B2 * | 1/2014 | Voronin | 175/428 |

OTHER PUBLICATIONS

Machine Translation of JP 2007-31301, Published Feb. 2007.*
International Search Report, PCT/EP2010/003245, Sep. 9, 2010.

* cited by examiner

WEARING ELEMENT WITH ENHANCED WEAR RESISTANCE

CROSS REFERENCE TO RELATED APPLICATIONS

This application is a National Stage of International Application No. PCT/EP2010/003245 filed May 28, 2010, claiming priorities based on U.S. Provisional Patent Application No. 61/213,321 filed May 29, 2009, Spanish Patent Application No. PCT/ES2009/000352 filed Jul. 1, 2009 and European Patent Application No. PCT/EP2009/005802 filed Aug. 10, 2009 the contents of all of which are incorporated herein by reference in their entirety.

FIELD OF THE INVENTION

The present invention relates to wearing elements, such as cast steel teeth to be specially used in machinery for earthmoving, ground-engaging and/or rock-cutting applications, as well as to inserts to be included within the wearing elements to enhance their wear resistance thus prolonging their service life.

BACKGROUND OF THE INVENTION

Prior Art

The insertion-casting of hard bodies into cast steel parts for earthmoving applications in order to enhance their wear resistance has been previously described in the state-of-the-art, as per example in U.S. Pat. No. 5,081,774 (Kuwano). This document describes a replaceable composite excavating tooth that comprises wear-resistant Cr-cast iron inserts having a higher hardness than a tooth body and being insert-cast into the tooth body. The performance of the excavating tooth is improved by locating the wear-resistant material as an integral insert at a central part of the tooth body. The insert extends from the tip end towards an attachment part of the tooth and terminates at a limiting position for the potential use of the teeth. Tooth replacement is then needed once the limiting position is reached. Although Cr-cast iron is a material that is somewhat similar to cast steel and therefore seemingly compatible as an insert in cast steel, it is desirable to increase the hardness of the insert above that of Cr-cast iron with the purpose of enhancing the overall wear behavior of the part.

From the different materials used in the state-of-the-art to constitute the hard bodies, or inserts, special attention has been given to the family of cermet materials (hard cemented ceramic-metal composites) due to their outstanding combination of hardness and toughness. Such properties have led to their common use in wear applications where abrasion and impact resistance are required. However, insertion of cermet reinforcing bodies into iron-based wearing elements by means of casting processes, where an iron-based alloy is poured into a mould cavity containing the cermet, has been reported to be problematic. Specifically, the prior art concerning insert-casting of a tungsten carbide based (WC-based) cermet been recognized to lead to the complete dissolution of the WC-based cermet (either as crushed particles or inserts) by the action of the iron-based alloy being cast.

Different strategies have been disclosed in the prior art to minimize the problem of insert dissolution. On the one hand, protective inter-layers have been introduced between the poured molten iron-based alloy and the WC-based cermet particles or inserts. These inter-layers are constituted by metallic alloys that are intended to remain, at least, partially intact in the finished product. This has been disclosed, for instance, in U.S. Pat. No. 4,764,255 (Fischer) for parts in cast iron and steel; for cast iron parts in U.S. Pat. No. 4,584,020 (Waldenstrom); and for cast steel parts ("Reinforcing Steel Castings With Wear-Resisting Cast Iron" Liteinoe Proizvodstvo, No. 7, p. 27 (1986), Furman et al.) In addition to selecting suitable high temperature alloys for the constitution of the protective inter-layers, the art teaches the use of sufficiently thick inter-layers (sheets), preferably between 1 and 8 mm in thickness, whose melting temperatures are >50° C. above that of the poured metal and more preferably 200° C. above of that of the poured metal in the art taught in U.S. Pat. No. 4,764,255 and U.S. Pat. No. 4,584,020. Moreover, Waldenstrom and Fischer disclose that the inter-layers shall be sufficiently thick as not to completely dissolve during the pouring of the steel. In the art taught by Furman, the inter-layers may comprise a low-melting temperature alloy, such as copper. In any case, it will be easily realized by anyone of skill in the art that providing a protective coating layer to a WC-based cermet insert represents an additional processing cost and complexity that would be preferably avoided.

On the other hand, limiting the pouring temperature of the alloy being cast has been recognized in the prior-art to lead to the successful introduction of WC-based cermet inserts in steel castings. International application number WO-2009/061274-A1 (Ederyd and Quarfordt) discloses a body consisting of a tungsten carbide cermet cemented by a cobalt-based binder having a carbon content close to graphite formation cast in a steel with a preferred carbon equivalent level higher than 0.5 and with a sufficiently low casting temperature to form a transition zone between the cemented carbide and the steel. Ederyd and Quarfordt, teach that some void and/or cracks in the bonding region between cermet and steel exist, although these defects are regarded as not being problematic for the performance of the component. However, for one skilled in the art, such defects may lead to unreliable performance of the reinforced parts in high-impact applications. In fact, the practice of limiting the pouring temperature of the steel to some low value to restrict superheat, as described in WO-2009/061274-A1, is insufficient to avoid formation of large defects in the bonding zone if the cooling rate of the casting during pouring and subsequent solidification is too low, as solved by the present invention. Moreover the prior art of Ederyd and Quarfordt teaches the existence of an eta-phase zone in the bonding zone and that the presence of a thin eta-phase zone does not affect the brittleness of the body. However, it is well-known in the art of the design, fabrication and use of cobalt-cemented tungsten carbide cermets, applied for example in cutting tools, that eta-phase, a cobalt-tungsten carbide, which is generally defined by the chemical formula $Co_xW_xC$ where x=3 or x=6, is excessively brittle, a cause of premature failures in use, and thus highly undesirable in any cermet-reinforced steel casting product subjected to impact, such as ground-engaging cast steel teeth. It is also well-known that high carbon content of the cementing cobalt, approaching graphite formation, inhibits the formation of eta-phase.

As described in the present invention, prevention of the formation of highly brittle phases is related to increasing the cooling intensity of the casting and thereby avoiding the excessive time at temperature that allows specific diffusional processes to occur, such as the diffusion of carbon, cobalt and tungsten that causes the formation of eta-phase.

SUMMARY OF THE INVENTION

The present invention relates to the processing of enhanced wear resistant components such as teeth for earth-moving, ground-engaging and/or rock-cutting machinery, having engineered high-performance bonds between cermet (i.e. cemented tungsten carbide) inserts that are harder than steel and the cast steel element wherein the insert is placed.

It is an object of the invention to provide an enhanced wear-resistant element constituted by gravity cast steel of any suitable carbon content, surrounding and specially bonded to a hard bulk cemented tungsten carbide insert. The invention concerns an innovative bonding of inserts with outstanding hardness within a tough impact-resistant cast steel.

The quality of the bonding that is developed between a cermet insert and cast steel is critical to the performance of the component and to the avoidance of sudden failures. Quality bonding is obtained if excessive macro-porosity and highly brittle zones are avoided. In our invention, bond quality is obtained by the penetration of the cementing matrix of the cermet by sufficiently hot liquid cast steel, dissolution of tungsten carbide particles in the outer layer of the penetrated portion of the cermet insert so as to enrich the liquid steel in tungsten, and rapid intensive cooling of the casting so as to form at least three, and sometimes four, chemically and structurally distinct bonding zones which restrict and/or eliminate macro-porosity and avoid highly brittle zones.

By properly developing the special bonding of the element of the invention as taught herein, it is unnecessary to metallically clad, or use metallic inter-layers, or otherwise coat, the insert, or to pre-cast the insert or use containers for the insert, or to practice any of the related methods of cermet or carbide particle protection disclosed in the prior art. A method for casting and thereby making a reinforced element of the invention is also described.

The reinforced wearing elements that are an object of the present invention have particular use in ground-engaging works in which the downtime cost is significantly high. The reinforced wearing elements of this invention thus allow the extension of effective working time between consecutive replacements. The reinforced wearing elements of this invention may substitute conventional ground-engaging tools (or elements), which are generally manufactured exclusively from low alloy steels. Therefore, the invention refers to different embodiments for reinforcing cast steel wearing elements whose use is intended in a wide spectrum of applications. The applications range from those mainly subjected to wear solicitations, to others where penetration against the ground plays a critical role in successful operation.

DESCRIPTION OF THE DRAWINGS

The present disclosure includes the following figures to illustrate the invention:

FIG. 3(*b*) shows a sectional scheme of a typical appearance of a bonding region where all four bonding zones, the substitution-bonding zone (1), the precipitation-bonding zone (2), the tungsten-carbide-free bonding zone (3) and the Chinese-writing bonding zone (4) are developed in an element of the invention.

FIG. 6(*a*) is a standard SEM image, while FIG. 6(*b*) is a back-scattered electron SEM image.

DETAILED DESCRIPTION OF THE PREFERRED EMBODIMENTS AND METHODS

An object of the present invention is the enhancement of the wear resistance of a wearing element, constituted by a gravity-cast steel containing at least one reinforcing hard bulk insert, i.e. a cemented tungsten carbide insert, characterized in that the bonding between the material of said insert and the cast steel guarantees the safe-operation of the wearing elements or reinforced components in service, preventing therefore, breakage of the elements related with defects in said bonding. In order to assure the desired good bonding between the cermet and the steel in the wearing element, the pouring temperature of the liquid steel must be sufficiently high so as to melt, displace and thereby penetrate the cementing matrix metal of the cermet, as well as to dissolve the tungsten carbide (WC) of the cermet in the outer layer of the penetrated portion, thereby enriching the liquid steel in this layer in tungsten and carbon thus resulting in the formation in this region of a liquid alloy containing tungsten, iron and carbon. Sufficiency of the pouring temperature is indicated and reflected by obtaining a penetration of the steel into the cermet of a depth greater than 1.5 mm as determined by subsequent inspection of the wearing element. In addition, the cooling intensity to which the wearing element (i.e. the casting) is subjected during and subsequent to the pouring of the steel must be sufficient to produce a wearing element characterized by the appearance of the inventive bonding between the steel and the cermet and thus prevent and/or avoid the problems of the prior art. This requires a cooling intensity that is sufficiently high to restrict the diffusion of tungsten and carbon that leads to the formation of excessively brittle regions. Sufficiency of the cooling intensity is indicated and reflected by obtaining a bonding zone, later defined as the tungsten-carbide-free bonding zone (3), which is free of tungsten carbide, and comprises an iron-rich metallic phase that is principally by weight iron and tungsten having a thickness greater than 20 μm and preferably in the range of 20 μm to 150 μm, as determined by subsequent inspection of the wearing element.

Figure 1:
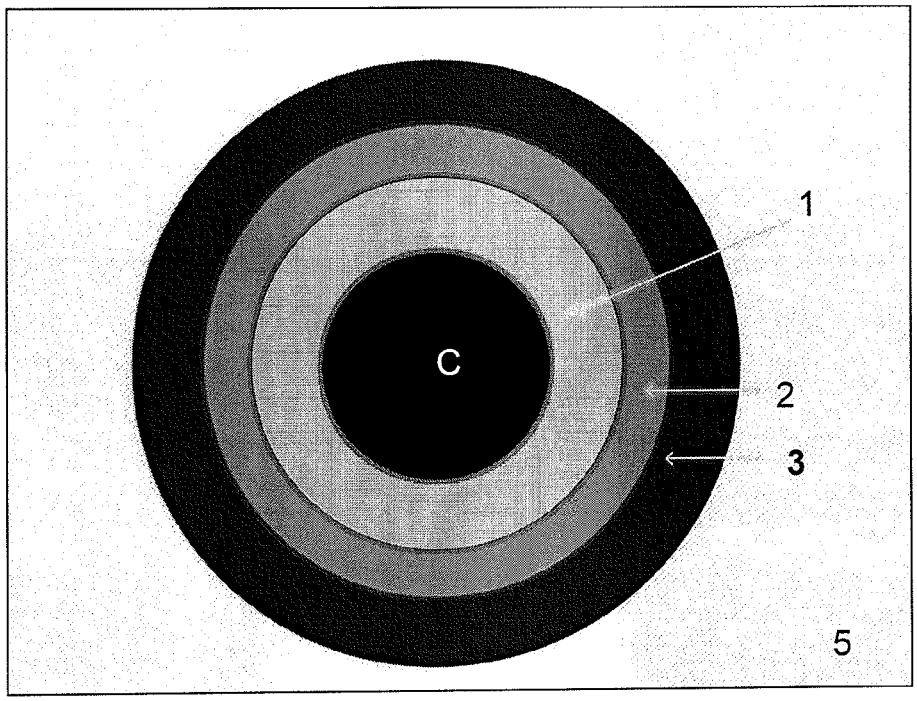
FIG. 1 shows a scheme of the three bonding zones between the core of the insert (C) and the cast metal (5) required to achieve a quality bond, the substitution-bonding zone (1), the precipitation-bonding zone (2) and the tungsten-carbide-free bonding zone (3).
Figure 2:
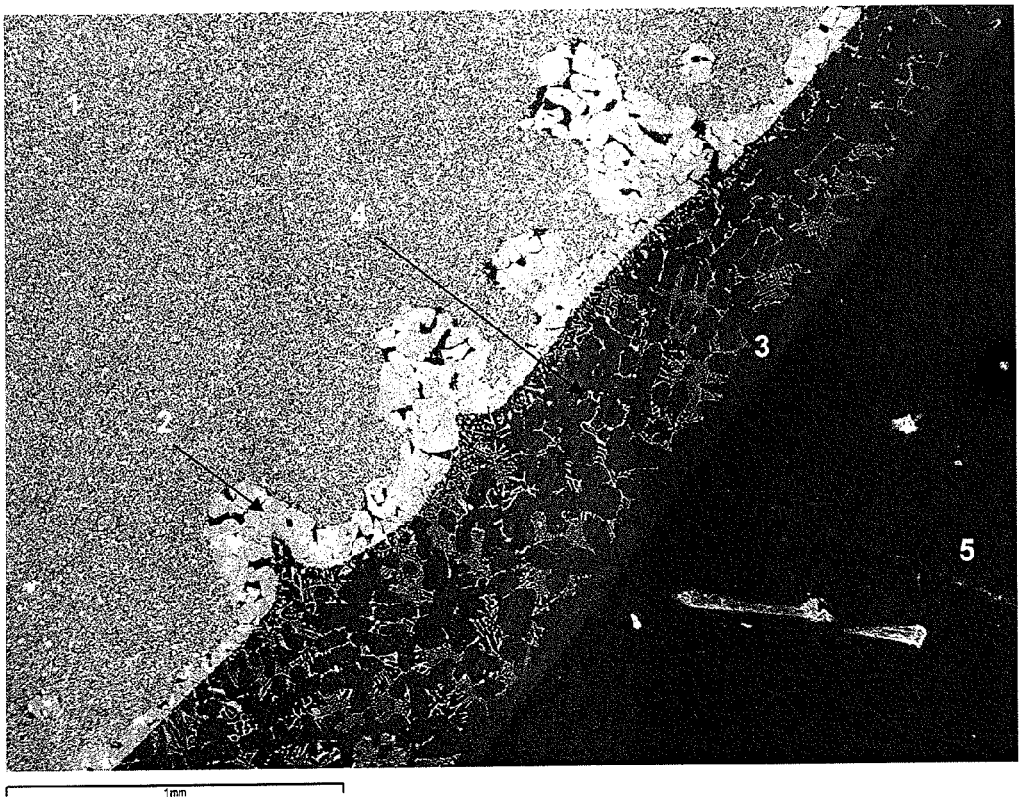
FIG. 2 shows a micrographic image of the four bonding zones that can be developed in a quality bond, the substitution-bonding zone (1), the precipitation-bonding zone (2) and the tungsten-carbide-free bonding zone (3) and the Chinese-writing bonding zone (4).

FIG. 1 and FIG. 2 show a general view of the bonding zones and structural features constituting the claimed element.

Figure 3A:
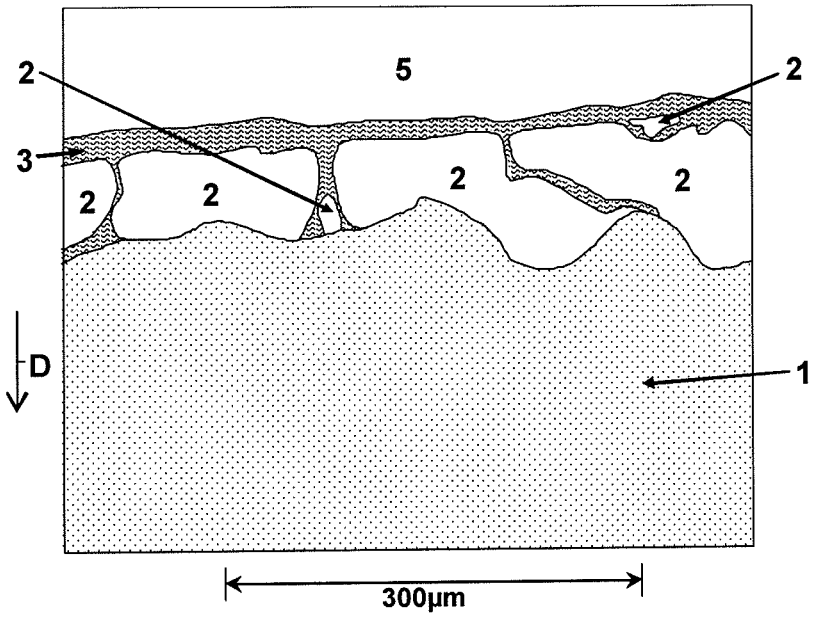
FIG. 3(*a*) shows a sectional scheme of a typical appearance of a bonding region where only three bonding zones, the substitution-bonding zone (1), the precipitation-bonding zone (2) and the tungsten-carbide-free bonding zone (3) are developed in an element of the invention.
Figure 3B:
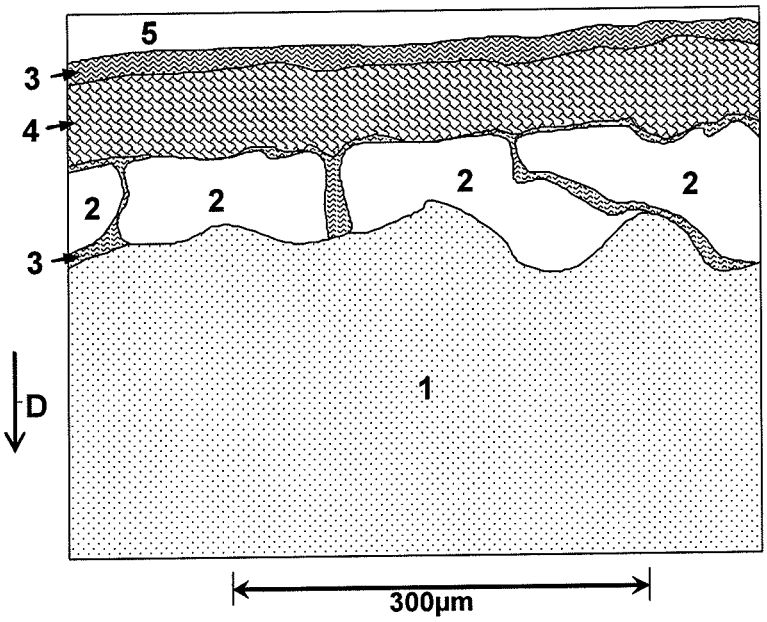

In accordance with the provision of sufficient steel pouring temperature to cause the liquid steel to penetrate the cermet and the provision of sufficiently intensive cooling of the casting during steel pouring and subsequent solidification to restrict diffusion, the bonding that is developed in a preferred embodiment of a wear element of the invention comprises at least three bonding zones, as shown in FIG. 3(*a*) in the wear element that is produced, namely; a substitution bonding zone (1), a precipitation bonding zone (2), and a tungsten-carbide-free zone (3). These bonding zones appear between the unaffected cast steel (5) and the core of the insert (C). The direction indicated by the arrow (D) in FIGS. 3(*a*) and 3(*b*) indicates a direction which is away from the surface of the cermet insert and towards the interior or core of the insert (C).

In what follows, chemical compositions of tungsten and iron within the constituent phases of each bonding zone are given as determined by the method of electro-dispersive spectrometry (EDS) performed with a scanning electron microscope (SEM), neglecting carbon content.

Figure 4:
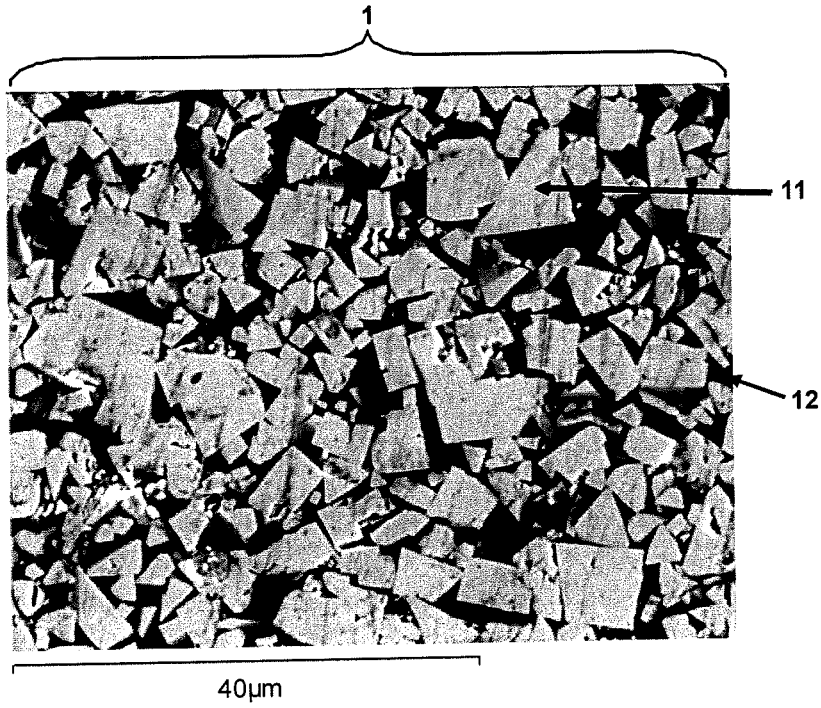
FIG. 4 shows an SEM (Scanning Electron Microscope) image of a section of an element of the invention where the field of view displays a region of the substitution bonding zone (1).

Referring to FIG. 4, the substitution bonding zone (1) is characterized by the appearance, within the wear element, of regions in which the cast steel has replaced the metallic cementing matrix of the cermet, so as to exhibit a bonding zone comprising a phase of tungsten carbide grains (11) surrounded by a phase of steel of substantially the same composition as the cast steel (12). The faceted light-colored grains (11) in FIG. 4 are constituted by tungsten carbide. The dark region (12) between the tungsten carbide grains (11) in FIG. 4 is constituted principally by cast steel. The carbide grains (11) in this zone (1) are substantially the same size, morphology and composition as the grains in the original cermet and/or the carbide grains in the core or in any un-penetrated by steel portion of the cermet insert (C). This bonding zone (1) or bonding layer can vary in thickness, however to ensure excellence of the bonding between the cermet and the steel, this zone should have a minimum depth of penetration into the cermet of a thickness in the range of 1.5 mm or greater.

Figure 5:
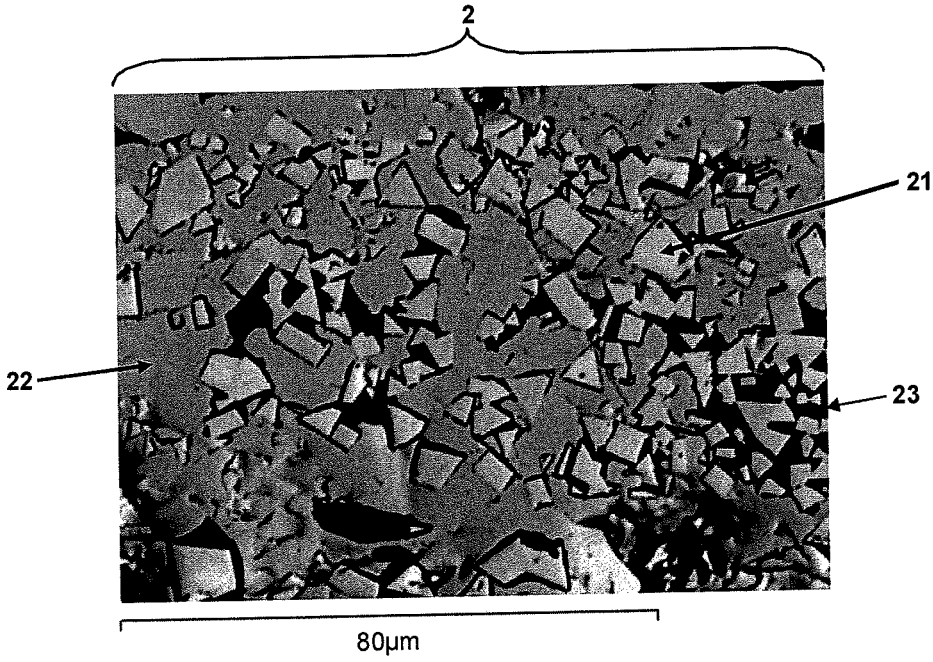
FIG. 5 shows an SEM image of a section of an element of the invention where the field of view displays a region of the precipitation bonding zone (2).

Referring to FIG. 5, the precipitation bonding zone (2), is characterized by the appearance within the wear element of regions wherein a tungsten-rich phase containing iron (22) partially or completely surrounds tungsten carbide grains (21). The faceted light-colored grains (21) in FIG. 5 are constituted by tungsten carbide and appear brighter than the surrounding tungsten-rich phase (22). Some of these grains (21) exhibit coarsening or have newly precipitated as compared to carbide grains (11) in the substitution bonding zone (1), or grains in the core, or in any un-penetrated by steel portion of the cermet insert (C). The tungsten-rich phase (22) has tungsten content typically in the range of 68 to 75% tungsten by weight, but may be as low as 60% depending on the cooling intensity. Thin tungsten-depleted areas of an iron-rich metallic phase (23) appear as dark regions, as seen in FIG. 5, immediately adjacent to the tungsten carbide grains (21). The iron-rich phase (23) of the precipitation-bonding zone (2) is not always evident.

The tungsten-carbide-free zone (3) is characterized by the appearance within the wear element of regions comprising an iron-rich metallic phase or solid solution that is principally by weight iron-tungsten, wherein the tungsten content of said iron-rich metallic phase is typically in the range 5 to 15% by weight tungsten but more generally less than 20% by weight. This bonding zone (3) may be as thin as 20 μm but may increase to 150 μm depending on the cooling intensity during solidification of the wear element. As shown in FIG. 3(*a*), the tungsten-carbide-free bonding zone (3) is typically adjacent to the precipitation-bonding zone (2). Precipitation-bonding zone (2) may appear on the form of small clusters surrounded or partially surrounded by the tungsten-carbide-free bonding zone (3).

The existence, thickness and extent of a fourth bonding zone (4) are affected by the cooling intensity. This additional bonding zone has the micro-structural appearance of Chinese-writing, which comprises an iron-rich phase (42), wherein the content of tungsten is typically in the range 5 to 15% by weight, and a tungsten-rich phase (41), wherein the content of tungsten is typically in the range of 68 to 75% by weight. The Chinese-writing appearance of this bonding zone (4) can be seen in FIG. 6(*a*) and FIG. 6(*b*), exhibiting the typical patterns of a peritectic decomposition of a liquid during solidification, involving the cooperative growth of the two solid phases (41,42) with one (41) of the phases displaying circular or globular features alternating with lamellae on a background of the other phase (42).

Figure 6A:
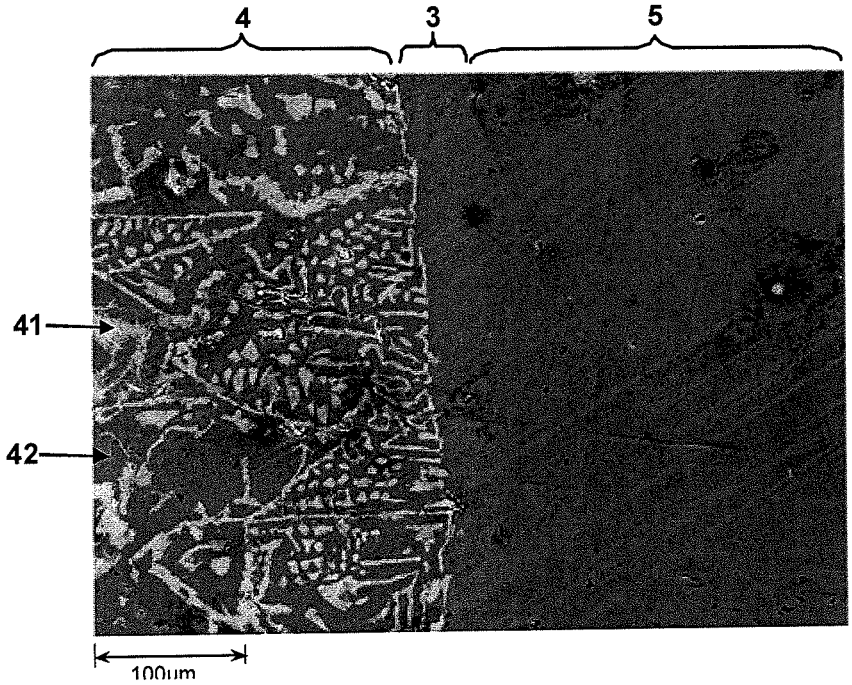
FIGS. 6(*a*) and 6(*b*) show an SEM image of a section of an element of the invention, where the field of view in each image is identical, displaying a region of the tungsten-carbide-free bonding zone (3), a region of the Chinese-writing bonding zone (4), and a region of unaffected cast steel (5).
Figure 6B:
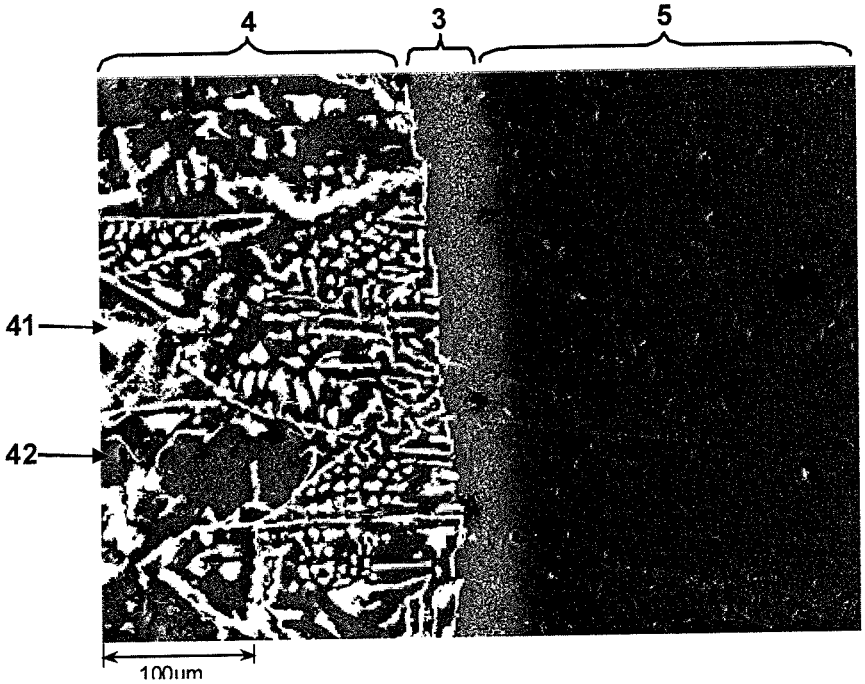

FIG. 6(*a*) and FIG. 6(*b*) each show an image, of identical field of view, containing a region of the tungsten-carbide-free bonding zone (3), a region of the Chinese-writing bonding zone (4) and a region of un-affected cast steel (5). The standard SEM image (FIG. 6(*a*)) provides only a small contrast between phases having different tungsten contents, while the back-scattered SEM image (FIG. 6(*b*)) enhances the brightness of phases containing tungsten. By comparing FIGS. 6(*a*) and 6(*b*), it can be seen that the Chinese-writing bonding zone (4) comprises two distinct phases where one phase (41) is brighter (i.e. higher in tungsten) than the other (42), while the tungsten-carbide-free zone (3) comprises only one distinct phase which has a similar brightness as the less bright (42) phase in the Chinese-writing bonding zone (4). The darkest region in FIG. 6(*b*) is the region of un-affected cast steel (5), which is dark because of its very low (nearly zero) tungsten content. In the Chinese-writing bonding zone (4), the tungsten-rich phase (41) forms the structures that are light and bright in appearance and have the look of Chinese characters, while the darker background is the iron-rich phase (42).

The Chinese-writing bonding zone (4) forms from the solidification of that portion of highly tungsten-enriched liquid metal, which is absent of any residual tungsten carbide grains, as these grains were completely dissolved by the liquid steel in any regions in which this bonding zone (4) appears. This liquid metal is the last liquid metal in the element to solidify and thus macro-porosity, related to the well-known tendency of solidification shrinkage to concentrate in regions of last solidification, tends to occur within or partially surrounded by regions of Chinese-writing zone (4). It is desired to minimize and/or nearly eliminate the extent of the Chinese-writing zone (4) and thereby restrict the size of any macro-porosity within the wear element. Increasing the cooling intensity restricts the time for dissolution of the WC grains of the cermet also favoring a strong decay of the overall tungsten content of Chinese-writing zone (4) in the direction of the poured steel (i.e., in the direction opposite of arrow D in FIG. 3(*b*)) with a consequent reduction in the fractional volume or area of the Chinese characters (41). Thus, the extent and occurrence of the Chinese-writing zone (4) can be minimized or fully-prevented by increasing the cooling intensity to which the wear element is subjected during the casting and solidification of the steel.

The preferred cermet used for the inserts of a preferred embodiment comprises tungsten carbide particles cemented by a cobalt or cobalt-nickel matrix. In this case, the aforementioned optimization of the bonding is performed through a combination of the following strategies. One strategy is the control of the temperature of the molten steel reaching the insert's surface such that this temperature substantially exceeds the melting point or liquidus temperature of the cementing metal. Another strategy is to provide a non-preheated molding system containing the insert, said molding system being adapted to provide sufficiently intense cooling to restrict the extent and occurrence of the Chinese-writing bonding zone (4), while increasing the extent and thickness of tungsten-carbide-free bonding zone (3).

According to the first strategy mentioned above, the pouring temperature of the steel should be adjusted and controlled by the known methods of the steel casting art until a penetration depth of the liquid steel into the surface of the bulk insert is greater than 1.5 mm, as evidenced by obtaining a substitution bonding zone (1) greater than 1.5 mm in thickness. According to the other strategy mentioned above, the cooling intensity of the molding system can be adjusted in accordance with the known methods of the steel casting art, such as; the incorporation of chills into the molding, design of the element and the insert to control the ratio between the amount of hot steel poured to the amount of the cold (non-preheated) insert, use of molding materials such as sands with appropriate thermal conductivities and heat capacities, and incorporation of cores in the element design and the molding system, with the objective of providing sufficiently intense cooling so as to prevent excessive penetration and dissolution of the cermet insert and to restrict the extent of the Chinese-writing zone (4) to substantially less than 3 mm in order to control macro-porosity thus assuring-performance of the wear element in end-use.

During the process by which the cast liquid steel penetrates the outer portion of the cermet insert, a significant portion of the metallic material of the cementing matrix of the cermet is displaced and pushed into the inner core of the insert (C). This alters the constitution of the insert not only in the outer portions of the insert where steel penetration occurred, but also in the inner region of the insert not penetrated by the steel (C), such that a portion of the core of the insert (C) contains a greater fraction of the matrix metal as compared to the original insert prior to insertion. Thus, proper penetration of the cermet by the cast steel is also indicated by an increase, in some portion of the inner-region (C) of the cast-steel-surrounded cermet, in the content of the cementing metal as compared to the cementing metal content of the original insert prior to casting or as compared to an unaffected portion of the central core of the insert (C). This process softens but also toughens the cementing-matrix-increased portions of the insert. Cobalt, or a cobalt-based alloy of cobalt-nickel, is the preferred cementing metal and in this case it has been found that at least an 80% increase in cobalt content can be achieved at some regions toward the inner core of the insert (C).

As previously disclosed, the preferred cermet insert is constituted by hard ceramic tungsten carbide particles in a metallic cobalt or cobalt-based matrix. The preferable fraction of the cobalt or cobalt-based matrix lies between 5 and 20% by weight. An increase of the metal matrix content above these limits enhances the toughness of the insert's core (C) after casting strongly reducing its hardness and is therefore undesirable to the present application. For cobalt contents below 5% by weight, infiltration becomes increasingly difficult. Moreover, since the matrix-increase in cobalt gained in the insert's core (C) after casting is relatively small for such low initial matrix metal content, the toughness enhancement in this region becomes negligible. By using the above-mentioned cermets in steel components that have been conventionally heat treated, it is recognized that although the Vickers hardness after casting in the region of matrix-increase is decreased to the range of 8-11 GPa for a WC—Co cermet whose original hardness was of 12.5 GPa prior to casting, this feature is counteracted by the associated increase in toughness. The preferred insert preferably contains more than 80% of its cross-sectional area comprised from WC particles whose mean equivalent diameter is 4 microns as measured through image analyses of a well-polished surface. Although some dissolution in the surface of such particles occurs by the action of the steel, the induced microstructural changes still allow achievement of the aforementioned Vickers hardness.

The nature and object of the invention will be made apparent by the following detailed description of one preferred embodiment of the invention.

The object of this embodiment is a wearing element, i.e. a cast steel tooth, to be specially used in hard-rock dredging applications. The main purpose of the wearing element is the deepening of hard-rock beds of ports, rivers, channels or the like.

The dredging tooth of the present example is reinforced with a WC-based cermet insert to improve its wear resistance thus prolonging its service life. The reliability of the reinforced tooth is assured by obtaining the quality bonding between the reinforcing cermet insert and the cast steel constituting the tooth. In the obtained bonding the existence of macro-porosity has been restricted by minimizing and/or controlling the extension of the Chinese-writing bonding zone (4).

The insert of the present embodiment is a sintered WC-based cermet rod of 100 mm in length by 20 mm in diameter. The metallic (cementing) matrix of the cermet consists of principally Co and represents the 11% by weight of the total insert. The other 90% by weight of the insert is constituted by WC particles of an average grain size of 4 μm.

The wear element has been produced using no-bake resin-bonded silica-based sand moulding, commonly referred to as the ISOCURE Process. The mould was not preheated and had a ratio of sand to steel of 2.5 kg sand/kg of cast steel. No special cores were used to reduce the amount of steel surrounding the cermet insert within the most massive portion of the wear element.

The weight of steel poured in the mould to constitute the wearing element and effectively surrounding the cermet insert was 17.6 kg. Steel pouring temperatures in the range of 1550-1650° C. were employed. These temperatures represent a superheating 50 to 150° C. above the melting temperature of the low-alloy cast steel used to constitute the wearing element. The wear elements of the example were shaken-out (i.e., removed from the sand) 4 hours after steel pouring.

Cracks and large macro-porosity were not entirely avoided by only controlling the pouring temperature of the steel contacting the insert, nor was the extension of the Chinese-writing bonding zone (4) properly limited. Micro-examination showed pores as large as 5 mm in thickness and Chinese-writing zones as thick as 15 mm.

More than one of the following actions can be combined to increase the cooling intensity for the purposes of restricting/eliminating macro-porosity and limiting the extent of Chinese-writing bonding zone (4) to a thickness much less than 3 mm in the greatest majority of the bonding surface between cermet and steel:

i) Redesigning the wear element geometry to allow the introduction of sand cores in the moulding so as to reduce the amount of steel surrounding the cermet insert and within the most massive portion of the wear element and thereby increasing the cooling intensity.

ii) Substitution of chromite- and/or zircon-based sands for the previously employed silica-based sand, based upon the higher thermal conductivities and heat capacities of these sands and thereby increasing the cooling intensity.

iii) Reducing the shake-out time of the casting and thereby increasing the cooling intensity.

iv) Introducing a steel insert in the proximity of the cermet insert or introducing a casting chill into the mould in the vicinity of the cermet insert, so that the melting of the steel insert by the poured steel or chilling of the poured steel increases the cooling intensity in the bond region.

In accordance with the above-disclosed actions, a wear element was produced. A redesign of the wearing element allowed the reduction of the amount of steel in the massive portion of the tooth and allowed the introduction of a chromite core in the vicinity of the insert, so as to effectively increase the cooling intensity. With the introduction of the chromite core, the clearance between insert and sand of the mold and/or the core ranged from 8 to 25 mm with respect to the great majority of the cermet insert. Pouring the steel at 1600° C. and shaking-out the casting within one hour of the pouring lead to the obtainment of a quality bond between insert and steel as is shown in FIG. 2. The substitution bonding zone (1) had a thickness ranging between 1.5 and 3 mm. The tungsten-rich phase (22) within the precipitation bonding zone (2) had a tungsten content ranging from 65% to 70% by weight. The tungsten-carbide-free bonding zone (3) had a minimum thickness of 30 μm and the tungsten content ranged from 10% to 14% by weight. The Chinese-writing bonding zone (4) did not appear in most of the developed quality bonding, but only appeared in the vicinity of the most massive portion of the casting where its thickness varied from 0 to 2.5 mm. The tungsten content of the tungsten-rich phase (41) of the Chinese-writing zone (4) ranged from 68% to 75% by weight, while the tungsten content of the iron-rich phase (42) ranged from 10% to 14% by weight. Macroporosity was absent throughout the bonding zones.

Field testing of the wear elements of this embodiment showed an in-service performance improvement in terms of wear life greater than 100% as compared to typical unreinforced wearing elements.

The invention claimed is:

1. A wearing element for earth engaging machines comprising:

a gravity-cast steel surrounding and bonded to at least one bulk insert of a cemented tungsten carbide cermet, said insert comprising tungsten carbide grains with a metallic cementing matrix, said wearing element comprising:

a substitution bonding zone, wherein the steel replaces the cementing matrix metal of the insert, to form a zone in which tungsten carbide grains are surrounded by steel;

a precipitation bonding zone, comprising a tungsten-rich phase, composed of tungsten and iron, and at least one of coarsened grains of tungsten carbide or precipitated grains of tungsten carbide; and a tungsten-carbide-free bonding zone, comprising an iron-rich metallic phase comprising iron and tungsten.

2. A wearing element according to claim 1, further comprising: a fourth bonding zone, adjacent to at least one of the tungsten-carbide-free bonding zone or the precipitation bonding zone, the fourth bonding zone having a micro-structure of Chinese-writing appearance, including an iron-rich phase and a tungsten-rich phase.

3. A wearing element according to claim 1, wherein said metallic cementing matrix of said insert comprises cobalt or a cobalt-based alloy.

4. A wearing element according to claim 3, wherein a matrix-increased region is formed within the insert having a Co content increased by at least 80% as compared to the Co content of the insert prior to casting or as compared to a portion of the insert which does trot include Co.

5. A wearing element according to claim 1, wherein said substitution bonding zone has a thickness greater than 1.5 mm.

6. A wearing element, according to claim 2, wherein said fourth bonding zone has a thickness less than 3 mm, so as to restrict or prevent formation of macro-porosity.

7. A wearing element according to claim 1, wherein a total thickness of said tungsten-carbide-free bonding zone is greater than 0.02 mm.

8. A wearing element, according to claim 1, wherein the tungsten content of said tungsten-rich phase of said precipitation bonding zone is greater than 60% by weight.

9. A wearing element according to claim 1, wherein the tungsten content of said tungsten-rich phase of said precipitation bonding zone is 68% to 75% by weight.

10. A wearing element according to claim 1, wherein the tungsten content of said iron-rich metallic phase of said tungsten-carbide-free bonding zone is greater than 5% and less than 20% by weight.

11. A wearing element, according to claim 2, wherein the tungsten content of said tungsten-rich phase of said Chinese-writing bonding zone is between 68% and 75% by weight.

12. A wearing element, according to claim 2, wherein the tungsten content of said iron-rich metallic phase of said fourth bonding zone is between 5% and 20% by weight.

13. A wearing element, according to claim 2, characterized in that the thickness of said fourth bonding zone is minimized by increasing the cooling intensity during the casting and solidification of the steel.

14. A wearing element according to claim 1, wherein said metallic cementing matrix of said insert comprises cobalt-nickel.

15. Process for producing a wearing element for earth engaging machines having a gravity-cast steel surrounding and bonded to at least one bulk insert of a cemented tungsten carbide cermet, said insert comprising tungsten carbide grains with a metallic cementing matrix, the process comprising:

pouring liquid steel around the insert at a temperature that is sufficiently high so as to melt, displace, and penetrate the cementing matrix metal of the cermet, as well as to dissolve the tungsten carbide of the cermet in an outer layer of the penetrated cement matrix, forming a substitution bonding zone with a penetration of the steel into the cermet of a depth greater than 1.5 mm, and cooling the wearing element at an intensity that is sufficiently high to restrict the diffusion of tungsten and carbon to obtain a tungsten-carbide-free bonding zone with an iron-rich metallic phase with a thickness greater than 20 μm.

16. Process, according to claim 15, wherein the cooling intensity is increased by using at least one of chromite- or zircon-based sands for moulding.

17. Process, according to claim 15, characterized in wherein the cooling intensity is increased in the bond region by the introduction of at least one of a steel insert or a chill casting in the proximity of the cermet bulk insert.

18. Process, according to claim 15, wherein the cooling intensity is increased by redesigning the wear element geometry to allow the introduction of sand cores in the moulding, so as to reduce the amount of steel surrounding the cermet insert and within the massive portions of the wear element.

19. A wearing element for excavation machines comprising:

a steel surrounding and bonded to at least one bulk insert of a cemented tungsten carbide cermet, said insert comprising tungsten carbide grains with a metallic cementing matrix;

a substitution bonding zone, wherein the steel replaces the cementing matrix metal of the insert;

a precipitation bonding zone, comprising a tungsten-rich phase, wherein the tungsten-rich phase comprises tungsten and iron; and a tungsten-carbide-free bonding zone, comprising an iron-rich metallic phase, wherein the iron-rich metallic phase comprises iron and tungsten.

* * * * *